United States Patent [19]

Lucien et al.

[11] Patent Number: 4,906,350

[45] Date of Patent: Mar. 6, 1990

[54] PROCESS FOR THE PREPARATION OF A LUBRICATING BASE OIL

[75] Inventors: Jacques Lucien; Gilbert Dutot, both of Grand Couronne, France

[73] Assignee: Shell Oil Company, Houston, Tex.

[21] Appl. No.: 258,416

[22] Filed: Oct. 17, 1988

[30] Foreign Application Priority Data

Jan. 14, 1988 [FR] France ..... 88 00360

[51] Int. Cl.[4] ..... C10G 65/04

[52] U.S. Cl. ..... 208/197; 208/18; 208/58; 208/111; 208/143; 208/28

[58] Field of Search ..... 208/18, 58, 143, 111, 208/28, 120, 97

[56] References Cited

U.S. PATENT DOCUMENTS

| | | | |
|---|---|---|---|
| 2,668,790 | 2/1954 | Good et al. | 196/50 |
| 2,668,866 | 2/1954 | Good et al. | 260/683.5 |
| 3,700,585 | 10/1972 | Chen et al. | 208/111 |
| 3,730,876 | 5/1973 | Sequena, Jr. | 208/58 |
| 3,801,493 | 4/1974 | Youngblood et al. | 208/120 |
| 3,830,723 | 8/1974 | Ladeur et al. | 208/108 |
| 4,347,121 | 8/1982 | Mayer et al. | 208/58 |
| 4,414,097 | 11/1938 | Chester et al. | 208/58 |
| 4,747,932 | 5/1988 | Miller | 208/58 |
| 4,795,546 | 1/1989 | Miller | 208/58 |

FOREIGN PATENT DOCUMENTS

| | | |
|---|---|---|
| 0092376 | 10/1983 | European Pat. Off. . |
| 0178699 | 5/1985 | European Pat. Off. . |
| 0225053 | 6/1987 | European Pat. Off. . |

*Primary Examiner*—Helane Myers

*Attorney, Agent, or Firm*—Kimbley L. Muller

[57] ABSTRACT

A process is disclosed for the preparation of a lubricating base oil with a high viscosity index and a low pour point by catalytic dewaxing, which process comprises contacting at dewaxing conditions a feedstock containing at least part of the hydrocrackate of a wax-containing mineral oil fraction, which feedstock has a kinematic viscosity at 100° C. of, at most, 10 $mm^2/s$, with a dewaxing catalyst. The invention further provides a lubricating mineral base oil comprising hydrocarbons with a boiling point of at least 250° C., and having a viscosity index of at least 125 and a pour point of at most −25° C.

8 Claims, No Drawings

PROCESS FOR THE PREPARATION OF A LUBRICATING BASE OIL

FIELD OF INVENTION

The present invention relates to a process for the preparation of a lubricating base oil with a high viscosity and a low pour point.

Lubricating base oils are derived from various mineral crude oils by a variety of refining processes. Generally, these refining processes are directed to obtaining a lubricating base oil with a suitable viscosity index. Other usual characteristics for lubricating base oils include pour point, boiling range and viscosity.

The preparation of high viscosity index lubricating base oils can be carried out as follows. A crude oil is separated by distillation at atmospheric pressure into a number of distillate fractions and a residue, known as long residue. The long residue is then separated by distillation at reduced pressure into a number of vacuum distillates and a vacuum residue known as short residue. From the vacuum distillate fractions lubricating base oils are prepared by refining processes. By these processes aromatics and wax are removed from the vacuum distillate fractions. From the short residue asphalt can be removed by known deasphalting processes. From the deasphalted oil thus obtained aromatics and wax can subsequently be removed to yield a residual lubricating base oil, known as bright stock. The wax obtained during refining of the various lubricating base oil fractions is designated as slack wax.

BACKGROUND OF THE INVENTION

In U.K. 1,429,494 (U.S. equivalent 3,830,723) a process is disclosed in which high viscosity index lubricating base oils are prepared by catalytic hydrocracking of wax that is obtained in the dewaxing of a residual mineral oil, by separating the hydrocracked product into one or more light fractions and a residual fraction, and by dewaxing the residual fraction to form a lubricating base oil. The dewaxing was carried out using a mixture of solvents. The lubricating base oil obtained in the known process had a viscosity index of up to about 155.

The drawback of the known process resides in the fact that although the viscosity index of the product obtained is excellent, the pour point of the product is not altogether satisfactory for certain applications, such as for use as refrigerator oils. That means that at certain temperatures that are not satisfactorily low, some constituents of the lubricating base oil begin to solidify. These constituents are in particular the unbranched paraffinic molecules.

It has already been acknowledged in the art that the desires as to a low pour point and a high viscosity index are contradictory, and that a balance is to be sought between removing waxy paraffins thereby obtaining a desired low pour point, and retaining branched isoparaffins in the lubricating base oil, which contribute to a good viscosity index. For instance, in EP 225,053 a process is disclosed for the production of a lubricating base oil, referred to therein as lube stock or lubricating oil stock, which has a low pour point and a high viscosity index. This is said to be achieved by a two-step process, in which the intermediate product obtained after a first dewaxing step has a pour point of at least 6° C. above the target pour point, i.e. the pour point of the product obtained after the second dewaxing step. Although this reference alleges that lubricating oil stocks with low pour point and high viscosity index are attainable, it appears from the examples that when a high viscosity index (VI), e.g. above 135, is obtained the pour point is relatively high, e.g. about −6.7° C., whereas when a really low pour point of about −20° C. is obtained the VI has a value of about 100 to 110. It is therefore apparent that the object set in the reference has not quite been achieved.

SUMMARY OF THE INVENTION

The present invention enables the achievement of the object raised in the last-mentioned reference. Accordingly, the present invention provides a process for the preparation of a lubricating base oil with a high viscosity index and a low pour point by catalytic dewaxing, which process comprises contacting at dewaxing conditions a feedstock containing at least part of the hydrocrackate of a wax-containing mineral oil fraction, which feedstock has a kinematic viscosity at 100° C. of at most 10 $mm^2/s$, with a dewaxing catalyst. By a low pour point is understood a pour point below −20° C. as determined by ASTM D-97, and by high VI is understood a viscosity index above 130 as determined by ASTM D-567.

DETAILED DESCRIPTION OF THE INVENTION

Catalytic dewaxing is a known process. In this respect, reference is made to e.g. U.S. Pat. No. 3,700,585 and EP 178,699. In catalytic dewaxing the feedstock to be dewaxed is suitably contacted with a dewaxing catalyst, preferably in the presence of hydrogen. Suitable catalysts that can be used as dewaxing catalysts include zeolitic catalysts. The catalytic dewaxing is preferably carried out in the presence of a zeolitic catalyst comprising at least one zeolite selected from the group consisting of ZSM-5, ZSM-11, ZSM-23, ZSM-35, ZSM-12, ZSM-38, ZSM-48, offretite, ferrierite, zeolite beta, zeolite theta, zeolite alpha and mixtures thereof. It is very preferred to use a catalyst which comprises a composite crystalline aluminium silicate as described in EP 178,699. Such a crystalline aluminium silicate is obtainable by maintaining an aqueous starting mixture comprising one or more silicon compounds, one or more aluminium compounds, one or more compounds of metals of group 1a of the Periodic Table of the Elements (MX) and an organic nitrogen compound at an elevated temperature until a composite aluminium silicate has formed and subsequently separating the crystalline aluminium silicate from the mother liquor, wherein the various compounds are present in the starting mixture within the following molar ratios:

$RN:R_4NY = 6–3000$, preferably 25–600, in particular 40–450, $SiO_2:R_4NY = 200–10000$, preferably 300–2000, in particular 450–1500, $SiO_2:Al_2O_3 = 60–250$, preferably 65–200, $SiO_2:MX < 10$, and $H_2O:SiO_2 = 5–65$, preferably 8–50, Where RN represents a pyridine and $R_4NY$ represents an organic quaternary ammonium compound.

RN preferably represents a compound selected from the group consisting of pyridine, alkyl pyridines and substituted-alkyl pyridines, and in particular represents pyridine. The substituent R in the quaternary ammonium compound is preferably an alkyl group in particular containing from 1 to 8 carbon atoms, and Y represents an anion. More preferably, the compound $R_4NY$ represents tetrapropyl ammonium hydroxide. For further details on the preparation of the composite crystalline aluminum silicate reference is made to EP 178,699.

The catalyst may further contain one or more hydrogenating metals from Groups 6b, 7b and 8 of the Periodic Table of the Elements or one or more compounds thereof. Of particular interest are the metals molybdenum, tungsten, chromium, iron, nickel, cobalt, platinum, palladium, ruthenium, osmium, rhodium and iridium. Platinum, palladium and nickel are especially preferred. The metals or their compounds may be deposited on the zeolites by means of any method for the preparation of catalysts known in the art, such impregnation, ion-exchange or (co)precipitation.

The metal-loaded catalysts suitably comprise from 1 to 50%wt., preferably from 2 to 20%wt., of a non-noble metal of Group 6b, 7b and/or 8; noble metals of Group 8 are suitably present in the catalysts in an amount of from 0.001 to 5% wt., preferably from 0.01 to 2% wt., all percentages being based on the total catalyst.

The catalytic dewaxing is preferably carried out at a temperature of 200° to 450° C., in particular from 250° to 400° C., and at a space velocity of 0.1 to 5.0 kg/l.catalyst.h, in particular from 0.5 to 2.0 kg/l.h. When the dewaxing is carried out in the presence of hydrogen the hydrogen (partial) pressure is preferably from 10 to 200 bar, in paticular from 30 to 150 bar and the hydrogen/feedstock ratio is preferably from 100 to 2000 Nl/kg, in particular from 300 to 1000 Nl/kg.

The product of the catalytic dewaxing may contain some relatively light products, i.e. products with a boiling point below 300°–400° C., e.g. below 370° C. Suitably, these products are separated from the dewaxed product, generally by distillation, to yield one or more light fractions and a lubricating base oil fraction. It is an advantage of the present invention that the yield on lubricating base oil is high. The complete effluent or the lubricating base oil fraction may conveniently be subjected to a hydrotreating step.

The said hydrotreating step is known in the art and may be carried out at known conditions. Suitable conditions include a temperature of 150° to 300° C., a hydrogen (partial) pressure of 30 to 150 bar, a space velocity of 0.5 to 4.0 kg/l.h and a hydrogen/feedstock ratio of 100 to 2000 Nl/kg. Suitable hydrotreating catalysts comprise nickel, cobalt, tungsten, molybdenum, platinum, palladium or mixtures thereof on a carrier, such as alumina, silica-alumina, silica, zirconia, zeolites and the like. The catalyst may further comprise fluorine, phosphorus and/or boron. Advantageously, the hydrogen pressure in the hydrotreating step is substantially the same as in the dewaxing step. The temperature, gas rate and space velocity can be selected by the person skilled in the art, suitably from the range given above.

The feedstock for the catalytic dewaxing is suitably a part of the hydrocrackate of a wax-containing mineral oil fraction. The hydrocrackate has conveniently been obtained by hydrocracking the wax-containing mineral oil fraction over a hydrocracking catalyst at a temperature of 360° to 420° C., a hydrogen (partial) pressure of 50 to 200 bar, a space velocity of 0.5 to 2.0 kg/l.catalyst.h. and a $H_2$/mineral oil fraction ratio of 500 to 2000 Nl/kg. The hydrocracking catalyst can be selected from any hydrocracking catalyst known in the art. Suitably the hydrocracking catalyst comprises a carrier and at least one hydrogenating metal or a compound thereof, which carrier has been selected from the group consisting of silica, alumina, silica-alumina and the faujasite-type zeolites. The most preferred faujasite-type zeolite Y. The most preferred hydrogenating metals are nickel, cobalt, tungsten and molybdenum and mixtures thereof, but platinum and/or palladium may also be used. The catalyst may further comprise fluorine and/or phosphorus and/or boron. When nickel, cobalt, molybdenum and/or tungsten are used as hydrogenating metal, they are preferably present in the form of their sulphides.

The starting materials for the hydrocracking step is a wax-containing mineral oil fraction. As is known in the art, wax consists essentially of paraffinic hydrocarbons which readily separate by crystallization when an oil fraction containing them is cooled. Conveniently, wax includes those hydrocarbons which separate by crystallization when the oil fraction is cooled to a temperature which may be as low as −50° C., suitably from −10° to −40° C., either in the absence or presence of one or more solvents, such as a ketone (methyl ethyl ketone, acetone) and an aromatic compound (benzene, toluene, naphtha). The wax-containing fraction to be used conveniently contains from 50 to 95% wt. of wax separated by cooling to a temperature which may be as low as −50° C. Suitably, the wax-containing fraction is slack wax separated from the distillate and/or residual lubricating base oils, as described above.

The hydrocrackate or at least the lubricating base oil fraction thereof may be passed directly to the catalytic dewaxing step. It may, however, be advantageous to subject the hydrocrackate or the lubricating base oil fraction thereof to a solvent dewaxing step first. In this way wax is produced that can be recycled to the hydrocracking step. The solvent-dewaxed hydrocrackate (fraction) is then used as feedstock for the catalytic dewaxing step. The solvent dewaxing can be carried out as described in the above British patent U.K. 1,429,494, using a mixture of methyl ethyl ketone and toluene or a mixture of a different ketone and/or a different aromatic compound.

The present process enables the production of high VI lubricating base oils, having a low pour point. The person skilled in the art is now enabled for the first time to prepare very high VI lubricating mineral base oils having very low pour points. Accordingly, the present process provides a lubricating mineral base oil comprising hydrocarbons with a boiling point of at least 250° C., and having a viscosity index of at least 125 and a pour point of at most −25° C. It is emphasized that the viscosity index and pour point are obtained in a lubricating base oil in the absence of additives. Due to the low pour point and high viscosity index the need for additives like VI improvers and pour point depressants is greatly reduced. This is advantageous since apart from the fact that these additives are expensive, they also tend to degrade during the use of the lubricating oil composition in which they are present, thereby deteriorating the lubricating properties of the composition. Such a lubricating base oil is obtainable by a process as described above.

The viscosity index of the lubricating base oil of the present invention may be as high as 160 and the pour point may be as low as −75° C. Conveniently, the lubricating base oils according to the present invention have a viscosity index of 130 to 150 and a pour point of −60° to −30° C.

The lubricating base oil according to the present invention comprises mineral hydrocarbons with a boiling point of at least 250° C. Suitably the lubricating base oil comprises hydrocarbons which boil for at least 90% wt at a temperature of at least 250° C. More preferably, the hydrocarbons boil for at least 90% wt at a temperature of at least 300° C., obtained by distillation at atmospheric or reduced pressure from the effluent of the catalytic dewaxing step described hereinbefore.

The lubricating base oil according to the present invention has a high viscosity index, but this does not say very much about the actual viscosity thereof. The kinematic viscosity of the lubricating base oil may range within wide limits, and is preferably from 1 to 10 $mm^2/s$ at 100° C., more preferably from 1.5 to 9.5 $mm^2/s$.

The present invention also relates to a lubricating oil composition comprising a mineral lubricating base oil containing hydrocarbons with a boiling point of at least 300° C. and having a viscosity index of at least 125 and a pour point of at most −25° C., and one or more lubricating oil additives. Such additives include optionally overbased detergents, such as alkaline earth metal sulphonates and carboxylates, in particular alkyl salicylates, dispersants, such as hydrocarbyl-substituted succinimides, and also foam inhibitors, corrosion inhibitors and anti-oxidants. Although the need for VI improvers and/or pour point depressants is reduced and addition thereof to the lubricating base oil is no longer required in many cases, the present invention also covers lubricating oil compositions that contain both a lubricating base oil according to the invention and one or more pour point depressants and/or VI improvers.

ILLUSTRATIVE EMBODIMENTS

The invention will be further illustrated by means of the following Examples.

EXAMPLES

In the experiments of the Examples a dewaxing catalyst was used which has been prepared in accordance with the procedure described in EP 178,699. The dewaxing catalyst used corresponded with the composite aluminum silicate denoted "Silicate B" in the said European application. Hence the catalyst had an aluminum content of 1.06% wt. The X-ray diffraction pattern of the catalyst showed the following lines:

| d-space (A) | $I/I_{max}$ (%) |
|---|---|
| 11.10 | 50 |
| 9.97 | 25 |
| 3.85 | 100 |
| 3.81 | 69 |
| 3.74 | 41 |
| 3.71 | 59 |
| 3.64 | 37 |
| 3.52 | 16 |
| 3.44 | 22 |

Different feedstocks were used in the experiments, but they have all been obtained by hydrocracking slack waxes from different mineral crudes.

Feedstock A comprised the hydrocrackate of slack waxes and had the following characteristics: the kinematic viscosity at 100° C. ($V_k100$) was 4.75 $mm^2/s$; the pour point (ASTM D-97) was 42° C.; the initial boiling point was 350° C. and there was a 50 percent recovery at 449° C. The wax content determined at −30° C. in the presence of methyl ethyl ketone (MEK)/ toluene (1:1 volume ratio) was 31.1% wt.

Feedstock B was a fraction of the hydrocrackate of slack wax which had been subjected to solvent dewaxing with a MEK/toluene mixture (1:1 volume ratio) at −22° C., and which had the following characteristics: $V_k100$ of 8.0 $mm^2/s$ and a pour point of −18° C.

Feedstock C was a fraction of the hydrocrackate of slack waxes which had been subjected to a solvent dewaxing step like feedstock B but at a temperature of −26° C. It had a $V_k100$ of 5.4 $mm^2/s$ and a pour point of −18° C.

Feedstock D was similar to Feedstock B and C, and had been solvent dewaxed at −26° C., and had a $V_k100$ of 4.2 $mm^2/s$ and a pour point of −21° C.

Feedstock E was a fraction of a slack wax hydrocrackate having a $V_k100$ of 6.27 $mm^2/s$ and a pour point of 38° C. The initial boiling point was 345° C., and 50 percent was recovered at 480° C. The wax content determined in the presence of a MEK/toluene mixture at −30° C. was 21.6%wt.

Feedstock F was a fraction of the hydrocrackate of slack wax which had been subjected to solvent dewaxing with MEK/toluene at −22° C. The $V_k100$ was 5.60 $mm^2/s$ and the pour point was −16° C.

EXAMPLE 1

The experiments of this Example have been carried out in a 300 ml reactor loaded with the above dewaxing catalyst, diluted with 0.2 mm SiC particles in a 1:1 volume ratio. The conditions under which the experiments have been carried out are indicated in Table I below. The product of the dewaxing was separated in a number of fractions and the fraction boiling at >370° C. was recovered as the desired lubricating base oil. The results of the experiments are indicated in Table I.

TABLE I

| Experiment No. | 1 | 2 | 3 | 4 | 5 | 6 | 7 |
|---|---|---|---|---|---|---|---|
| Feedstock | A | A | B | C | C | D | D |
| Temperature,°C. | 380 | 380 | 400 | 380 | 360 | 360 | 340 |
| WHSV, kg/l.h | 1.0 | 0.5 | 1.0 | 1.0 | 1.0 | 1.0 | 1.0 |
| $H_2$ pressure, bar | 90 | 90 | 40 | 40 | 90 | 90 | 90 |
| Gas rate, Nl $H_2$/kg | 700 | 700 | 700 | 700 | 700 | 700 | 700 |
| YIELD, % wt on feedstock | | | | | | | |
| $C_{1-4}$ | 51.2 | 57.9 | 26.9 | 29.2 | 20.8 | 29.1 | 24.0 |
| $C_5$-370° C. | 8.0 | 6.5 | 5.1 | 14.0 | 10.8 | 15.3 | 11.5 |
| >370° C | 40.7 | 35.6 | 68.0 | 56.8 | 68.4 | 55.6 | 64.5 |
| OIL PROPERTIES | | | | | | | |
| $V_k100$, $mm^2/s$ | 4.89 | 4.82 | 7.85 | 5.23 | 5.34 | 4.30 | 4.33 |
| VI | 127 | 123 | 135 | 127 | 130 | 126 | 130 |
| pour point, °C. | −42 | −54 | −36 | −51 | −40 | −39 | −33 |

From the above results it is apparent that the process according to the invention yields lubricating base oils with excellent pour points and VI's.

EXAMPLE 2

In the experiments of this Example two reactors were used in series, each of the size of the reactor used in Example 1. The first reactor was loaded with the dewaxing catalyst like in Example 1. The second reactor contained a hydrotreating catalyst comprising 2.5%wt of nickel, 13.5%wt of molybdenum and 2.9%wt of phosphorus on alumina, the percentages being based on total catalyst. The operating conditions were: $H_2$ pressure of 90 bar, a gas rate of 700 Nl $H_2$/kg feedstock, and a space velocity, based on each reactor, of 1 kg/l/h. The temperatures in the reactors ($T_1$ and $T_2$, respectively) and the results of the experiments are indicated in Table II.

TABLE II

| Experiment No. | 8 | 9 | 10 | 11 | 12 |
|---|---|---|---|---|---|
| Feedstock | E | E | E | F | F |
| $T_1$, °C. | 360 | 340 | 320 | 300 | 320 |
| $T_2$, °C. | 250 | 250 | 250 | 250 | 250 |
| YIELD, % wt on feedstock | | | | | |
| $C_{1-4}$ | 33.4 | 28.5 | 23.7 | 11.6 | 16.9 |
| $C_5$-370° C. | 6.0 | 9.1 | 8.9 | 7.5 | 7.4 |
| >370° C. | 60.6 | 62.4 | 67.4 | 80.9 | 75.7 |
| OIL PROPERTIES | | | | | |
| $V_k100$, $mm^2/s$ | 6.26 | 6.37 | 6.34 | 5.87 | 5.87 |
| VI | 132 | 134 | 136 | 137 | 136 |
| pour point, °C. | −53 | −44 | −32 | −30 | −31 |

The above results show that excellent lubricating base oils can be obtained when the dewaxing process according to the invention is followed by a hydrotreating step.

We claim as our invention:

1. A process for the preparation of a lubricating base oil product having a pour point below −20° C. and a viscosity index above 130 which comprises catalytically dewaxing in the presence of hydrogen and a dewaxing catalyst comprising a composite crystalline aluminum silicate obtained by maintaining an aqueous starting mixture comprising one or more silicon compounds, one or more aluminum compounds, one or more compounds of metals group 1a of the Periodic Table of Elements and an organic nitrogen compound at an elevated temperature for a period of time until a composite aluminum silicate has formed and subsequently separating the crystalline aluminum silicate from the mother liquor, wherein the various compounds are present in the starting mixture within the following molar ratios:

$RN:R_4NY = 6-3000$ $SiO_2:R_4NY = 200-10{,}000$ $SiO_2:Al_2O_3 = 60-250$ $SiO_2$: compounds of metals of group 1a < 10, and $H_2O:SiO_2 = 5-65$, wherein RN represents a pyridine and $R_4NY$ represents an organic quaternary ammonium compound, at conditions comprising a temperature of 200° to 450° C. and at a space velocity of 0.1 to 5.0 kg/l.catalyst.h, a hydrogen (partial) pressure of 10 to 200 bar and a hydrogen/feedstock ratio of 100 to 2000 Nl/kg, a hydrocrackate comprising a slack wax mineral oil fraction containing 50 to 95% wt wax and having a kinematic viscosity at 100° C. of, at the greatest, 10 $mm^2/s$, and recovering said lubricating base oil product having said pour point below −20° C. and said viscosity index above 130.

2. The process according to claim 1 in which said dewaxing catalyst comprises at least one zeolite selected from the group consisting of ZSM-5, ZSM-11, ZSM-23, ZSM-35, ZSM-12, ZSM-38, ZSM-48, offretite, ferrierite, zeolite beta, zeolite theta, zeolite alpha and mixtures thereof.

3. The process according to claim 1, in which said dewaxing catalyst comprises one or more hydrogenating metals from the groups 6b, 7b and 8 of the Periodic Table of Elements or one or more compounds thereof.

4. The process according to claim 1, in which said hydrogenating metal is nickel, platinum and/or palladium.

5. The process according to claim 1, in which the lubricating base oil product is subjected to hydrotreatment after dewaxing.

6. The process according to claim 1 in which the hydrocrackate is obtained by hydrocracking a wax-containing mineral oil fraction over a hydrocracking catalyst at a temperature of 360° to 420° C., a hydrogen (partial) pressure of 50 to 200 bar, a space velocity of 0.5 to 2.0 kg/l.catalyst.h and a $H_2$/mineral oil fraction ratio of 500 to 2000 Nl/kg.

7. The process according to claim 6, in which said hydrocracking catalyst comprises a carrier and at least one hydrogenating metal or a compound thereof, which carrier has been selected from the group consisting of silica, alumina, silica-alumina and the faujasite-type zeolites.

8. The process according to claim 1, in which the hydrocrackate has a kinematic viscosity at 100° C. of 1.5-9.5 $mm^2/s$.

* * * * *